US009822608B2

(12) United States Patent
Avant

(10) Patent No.: US 9,822,608 B2
(45) Date of Patent: Nov. 21, 2017

(54) OPPOSED RAMP ASSEMBLY FOR SUBTERRANEAN TOOL WITH LOAD BEARING LUG AND ANTI-JAM FEATURE

(71) Applicant: BAKER HUGHES INCORPORATED, Houston, TX (US)

(72) Inventor: Marcus A. Avant, Kingwood, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 280 days.

(21) Appl. No.: 14/577,060

(22) Filed: Dec. 19, 2014

(65) Prior Publication Data

US 2016/0177669 A1 Jun. 23, 2016

(51) Int. Cl.

| | |
|---|---|
| ***E21B 34/14*** | (2006.01) |
| ***E21B 23/00*** | (2006.01) |
| ***E21B 34/10*** | (2006.01) |

(52) U.S. Cl.

CPC ..... *E21B 34/14* (2013.01); *E21B 23/006* (2013.01); *E21B 34/10* (2013.01)

(58) Field of Classification Search

CPC ..... E21B 34/14; E21B 34/10; E21B 23/006
USPC ..... 166/331
See application file for complete search history.

(56) References Cited

U.S. PATENT DOCUMENTS

| | | | |
|---|---|---|---|
| 8,186,439 | B2 | 5/2012 | Lauderdale |
| 2004/0007356 | A1 | 1/2004 | Myron |
| 2009/0159290 | A1 | 6/2009 | Lauderdale |
| 2010/0243253 | A1 | 9/2010 | Surjaatmadja |
| 2012/0205117 | A1 | 8/2012 | Harms |

FOREIGN PATENT DOCUMENTS

| | | | |
|---|---|---|---|
| WO | 2013016354 | A2 | 1/2013 |

*Primary Examiner* — Taras P Bemko
(74) *Attorney, Agent, or Firm* — Steve Rosenblatt

(57) ABSTRACT

An opposed ramp assembly is configured with a load bearing lug. The lug has angled ends that match the opposed profile shapes that rotate as the lug reciprocates with each piston stroke. One side of the opposed profiles of the opposed ramp pattern has no axial travel grooves for the lug. On the other side there can be one or more open slots for the lug to facilitate assembly and disassembly of the lug to the operating location or to accommodate one or more needed positions for the tool depending on the application. As a result the opposed pattern peaks have increased spacing for the same stroke length of the piston. This allows for more reaction time in a partial stroke to avoid jamming because the potential position for jamming is far later so that reversal of movement can occur without jamming, if it occurs in the early part of the stroke. Peak to peak axial separation of the opposed pattern profiles is increased by a factor of at least 24.

17 Claims, 8 Drawing Sheets

OPPOSED RAMP ASSEMBLY FOR SUBTERRANEAN TOOL WITH LOAD BEARING LUG AND ANTI-JAM FEATURE

FIELD OF THE INVENTION

The field of the invention is design of opposed ramp assemblies used to operate subterranean tools into multiple positions and more particularly using a load bearing lug shaped to mesh with mating shapes that define the opposed ramp pattern while eliminating axial travel slots extending from the shaped pattern while further spacing pattern peaks apart to reduce jamming when reversing a partial stroke.

BACKGROUND OF THE INVENTION

FIGS. 1 and 2 represent the prior art. Referring to FIGS. 1 and 2, a valve housing 10 has control lines 12 and 14 that extend to opposite sides of piston 16. Piston 16 is connected to insert sleeve 18 for tandem movement. Insert sleeve 18 has a hole pattern 20 that moves up and down into and out of alignment with openings 22 in the housing 10. Seals 24 and 26 straddle ports 22 so that when openings 20 are not between seals 24 and 26 the valve is fully closed. On the other hand when the ports 20 are between seals 24 and 26, as shown in FIG. 1, then the valve is in the diffused position where some flow is possible between ports 20 and 22 through diffuser 28. Alternating pressure application between lines 12 and 14 forces relative movement of pin 30 in the j-slot pattern 32. A series of stair step travel stops 34 define how much more open the valve gets in each pressure cycle. The other half of each cycle has the lug 36 landing on the same spot 38 to define the diffused position shown in FIG. 1. In each pressure cycle, the lug 36 lands on a different step 34 to represent another opening increment. After a predetermined number of cycles the lug 36 can go to landing 40 for a fully closed position where the openings 20 are no longer between seals 24 and 26. In the very next cycle it can go to fully open when lug 36 is allowed to keep traveling by slot 41 until it hits stop 42. These FIGS. are from U.S. Pat. No. 8,186,439.

Notable in this design are the fact that the pin 30 is not load bearing. Instead, the load is taken up by lug 36 landing at 38 for the diffused position and steps 34 to define the various percent open positions of the illustrated choke. As a result of this design where the pin 30 takes no load but is used to simply create rotation to move the valve into intermediate positions, there are long pin travel slots 44 and 46 that enable such action but as a result due to limited stroke length of piston 16 the opposed peaks 48 and 50 are brought very close to each other. If fully cycling through the various positions there is normally no jamming problem. Jamming can occur if there is a partial piston stroke followed by a reversal of the movement which can land the pin 30 on the peak such as 50 that the pin just passed. This can deform the pin to an extent that further stroking of the piston 16 can be to no avail as the valve will jam. The close fit of the peaks 48 and 50 gives surface personnel little time to respond to prevent such a jamming situation when there is a partial stroke.

The present invention employs a load bearing lug that preferably has angled end surfaces and more preferably has a trapezoidal shape. The opposed ramp profile has a generally mating shape to the lug opposed ends. Because of this feature allowing the elimination of the axial travel slots for the pin 30 in the prior art the opposed patterns that define the j-slot profile can be placed further apart for the same piston stroke capability. Placing the opposed mating patterns further apart allows more time in a partial stroke situation for the operator to react and back off the movement before that critical alignment occurs that can jam the valve. By having the extra time to react due to the enhanced spacing which increases axial peak to peak distance from about ⅛" to over 3" more of a partial stroke can be accomplished with the ability to back off the stroke without jamming. Shorter enlarged distances that still exceed the prior peak distance of ⅛" are also contemplated. While jamming is still possible with a partial stroke, the potential for the jamming having been moved to near the end of the full stroke from very near the beginning of the full stroke as in the prior art allows the surface personnel reaction time that could be instrumental in avoiding a jam situation altogether. There is no incremental increase in tool length due to the peak to peak separation as the load bearing lug allows for the elimination of the axial travel slots on one side of the pattern. Open slots on the other side are envisioned to allow assembly of the lug between the patterns and to allow needed positions for the subterranean tool. These and other aspects of the present invention will be more readily apparent to those skilled in the art from a review of the detailed description of the preferred embodiment and the associated drawings while recognizing that the full scope of the invention is to be determined by the appended claims.

SUMMARY OF THE INVENTION

An opposed ramp assembly is configured with a load bearing lug. The lug has angled ends that match the opposed profile shapes that rotate as the lug reciprocates with each piston stroke. One side of the opposed profiles of the ramp pattern has no axial travel grooves for the lug. On the other side there can be one or more open slots for the lug to facilitate assembly and disassembly of the lug to the operating location or to accommodate one or more needed positions for the tool depending on the application. As a result the opposed pattern peaks have increased spacing for the same stroke length of the piston. This allows for more reaction time in a partial stroke to avoid jamming because the potential position for jamming is far later so that reversal of movement can occur without jamming, if it occurs in the early part of the stroke. Peak to peak axial separation of the opposed pattern profiles is increased by a factor of at least 24.

DETAILED DESCRIPTION OF THE PREFERRED EMBODIMENT

Figure 7:
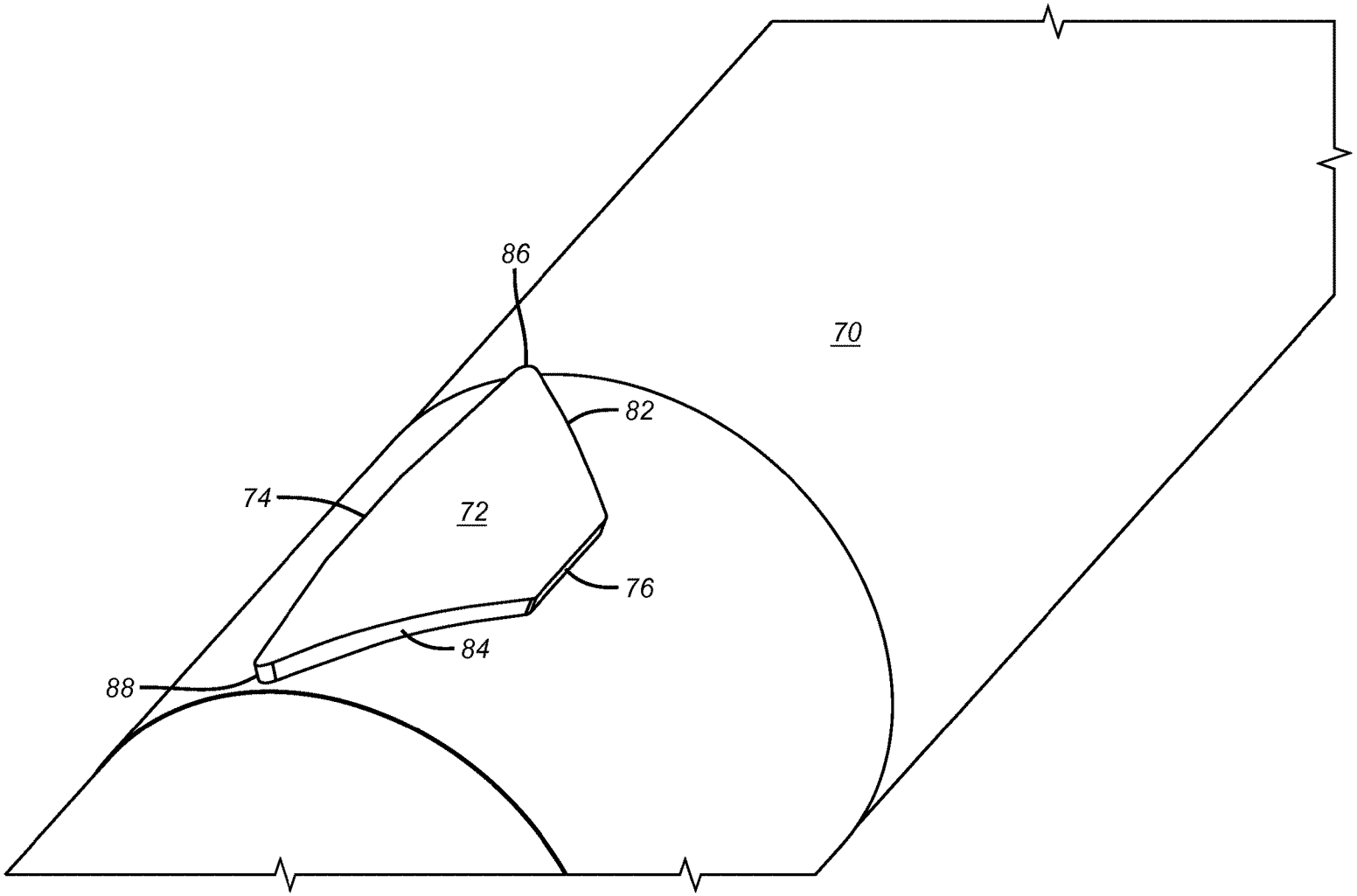
FIG. 7 is a perspective view of the lug shaft that is reciprocated with a piston driver.
Figure 8:
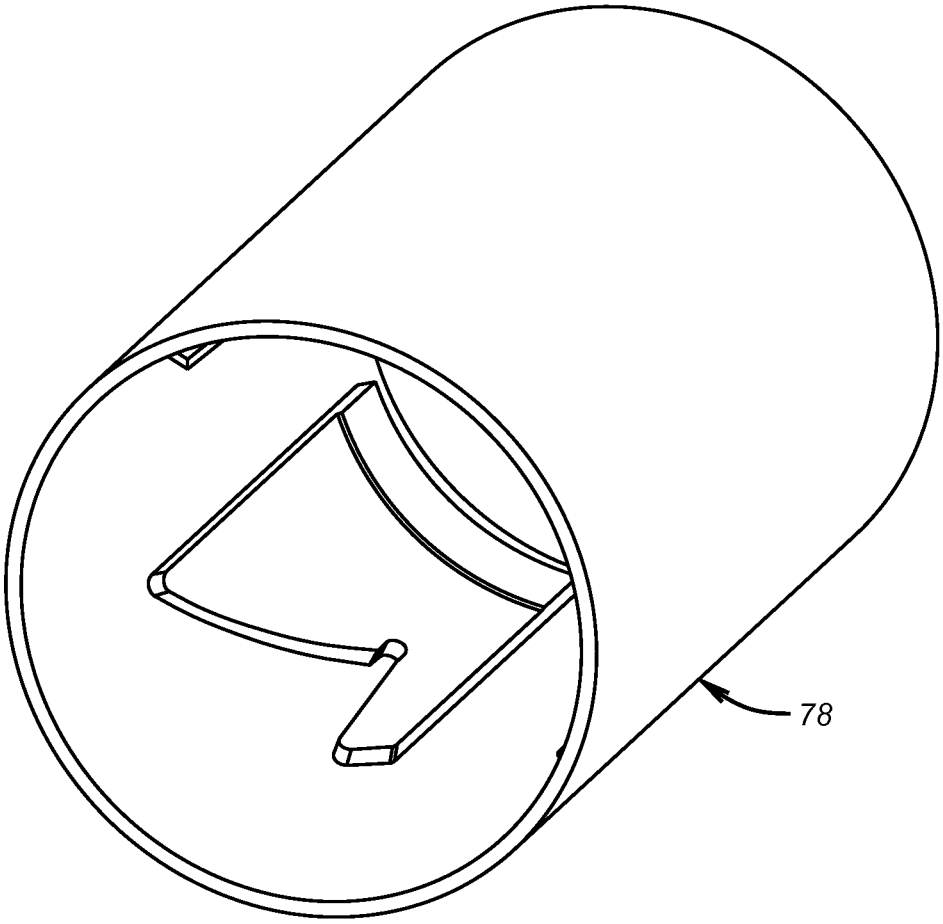
FIG. 8 is a perspective view of one of opposing parts that define the opposed ramp pattern.
Figure 9:
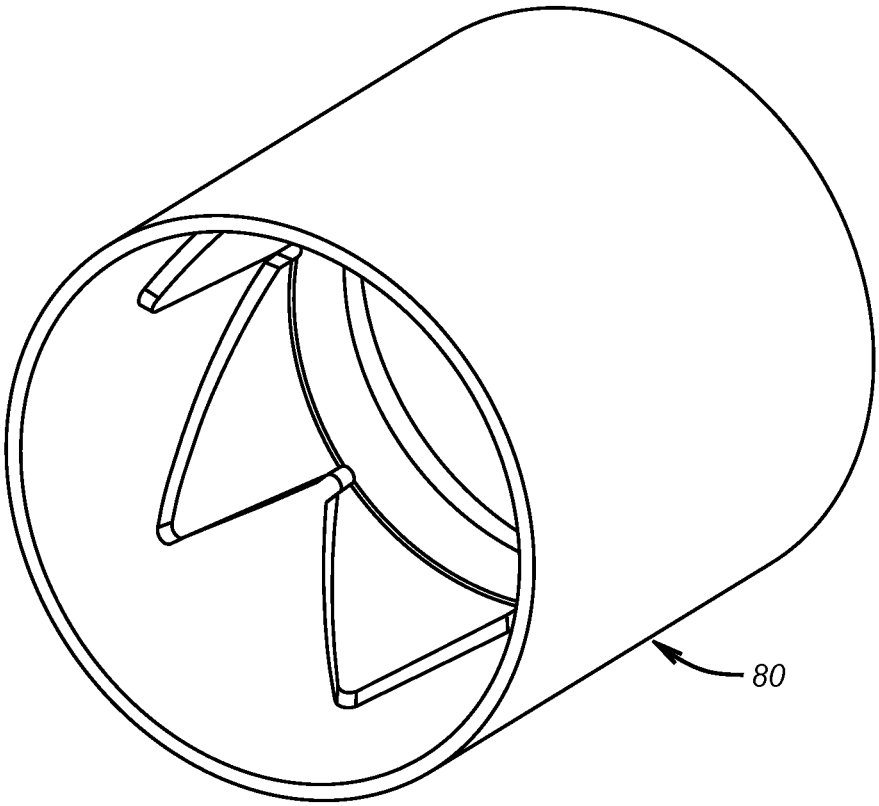
FIG. 9 is a perspective view of the opposing part to the FIG. 8 part that completes the opposed ramp pattern.

FIG. 7 illustrates a tubular shaft 70 that contains a load bearing lug 72 that is preferably an axially oriented trapezoidal shape with its long side surface 74 and opposing short side surface 76 being axially oriented and parallel to a longitudinal axis of the tubular shaft 70. Shaft 70 is reciprocated between opposed indexing sleeves 78 and 80 shown respectively in perspective in FIGS. 8 and 9. Sleeves 78 and 80 are preferably attached for tandem rotation in response to opposed reciprocal movement of the lug 72. Lug 72 has angled surfaces 82 and 84 between parallel surfaces 74 and 76 to complete the trapezoidal shape. Rounded transition 86 is between surfaces 82 and 74 and rounded transition 88 is between 74 and 84. The angles at transitions 86 and 88 by extension of the surfaces on either side of them can be the same or different.

Figure 3:
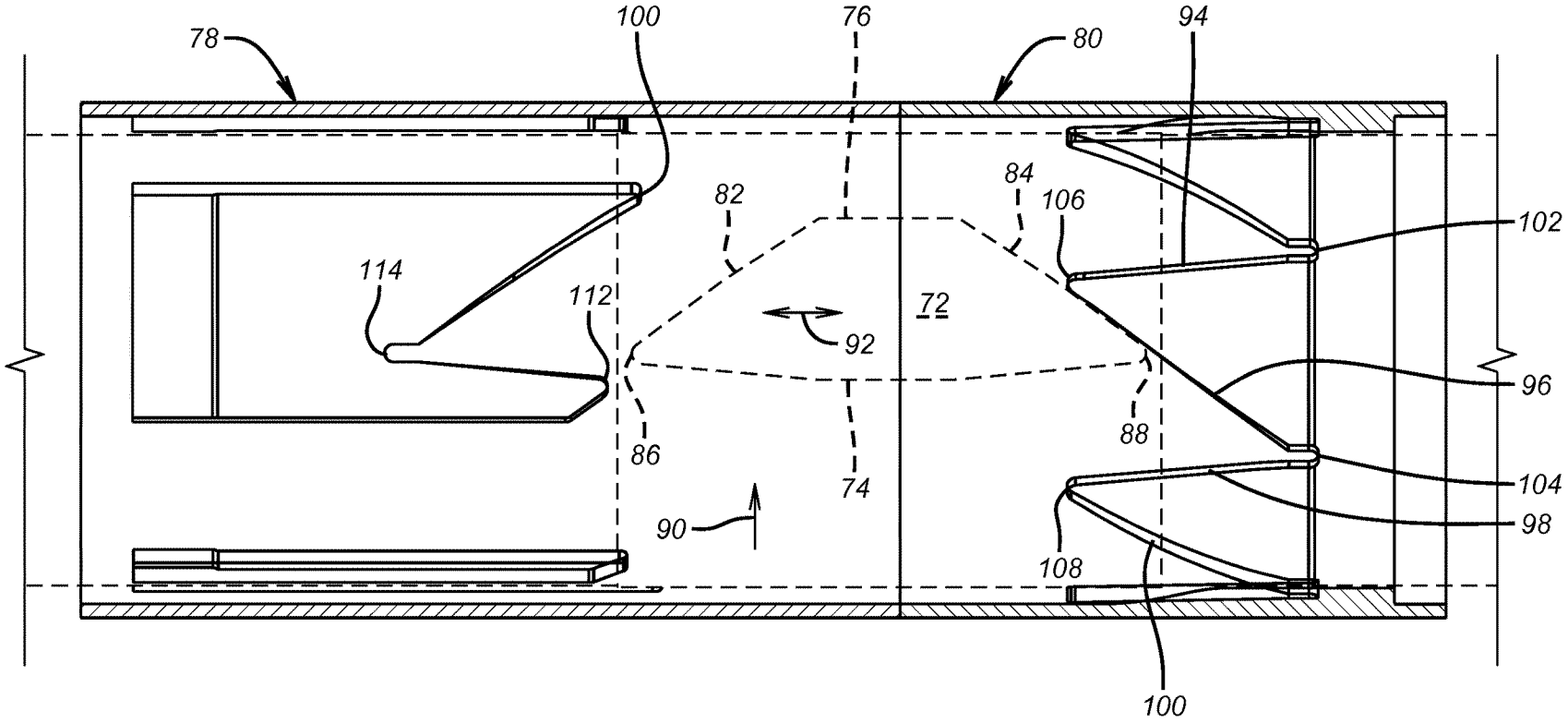
FIG. 3 shows the load bearing lug in a partial stroke position and before a stroke reversal would cause jamming.

FIG. 3 shows the juxtaposition of sleeves 78 and 80 which preferably rotate in tandem in the direction of arrow 90 as lug 72 reciprocates in the direction of double-headed arrow 92. Sleeve 80 preferably has a repeating profile of surfaces 94, 96, 98 and 100 and so forth for preferable a 360 degree distance all around the periphery of the sleeve 80. Each valley such as 102 and 104 is defined by a short axially oriented slot with a round bottom that is well shorter (less than 10%) than the axial height of the peaks such as 106 or 108. The purpose of this shape of the valleys 102 and 104 is to reduce stress at that location as opposed to just having, for example, surfaces 96 and 98 meet at a sharp angle such as preferably between 30 and 60 degrees. As shown in FIG. 3 there are spaced apart peaks 106 and 108 on opposed sides of a valley 98 in the repeating pattern that is shown. Surface 84 of lug 72 has traveled into contact with surface 96 and rotation is about to begin with any further axial advancement of the lug 72.

Figure 1:
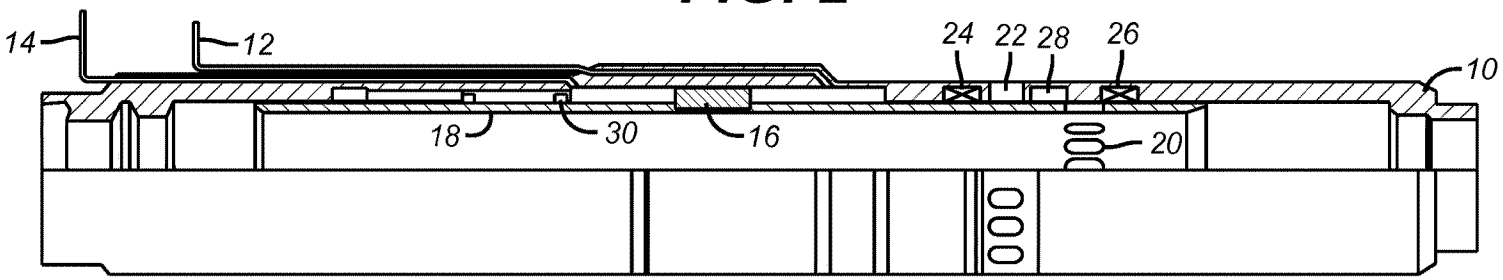
(PRIOR ART) FIG. 1
FIG. 1 is a prior art part section view of a choke valve.
Figure 4:
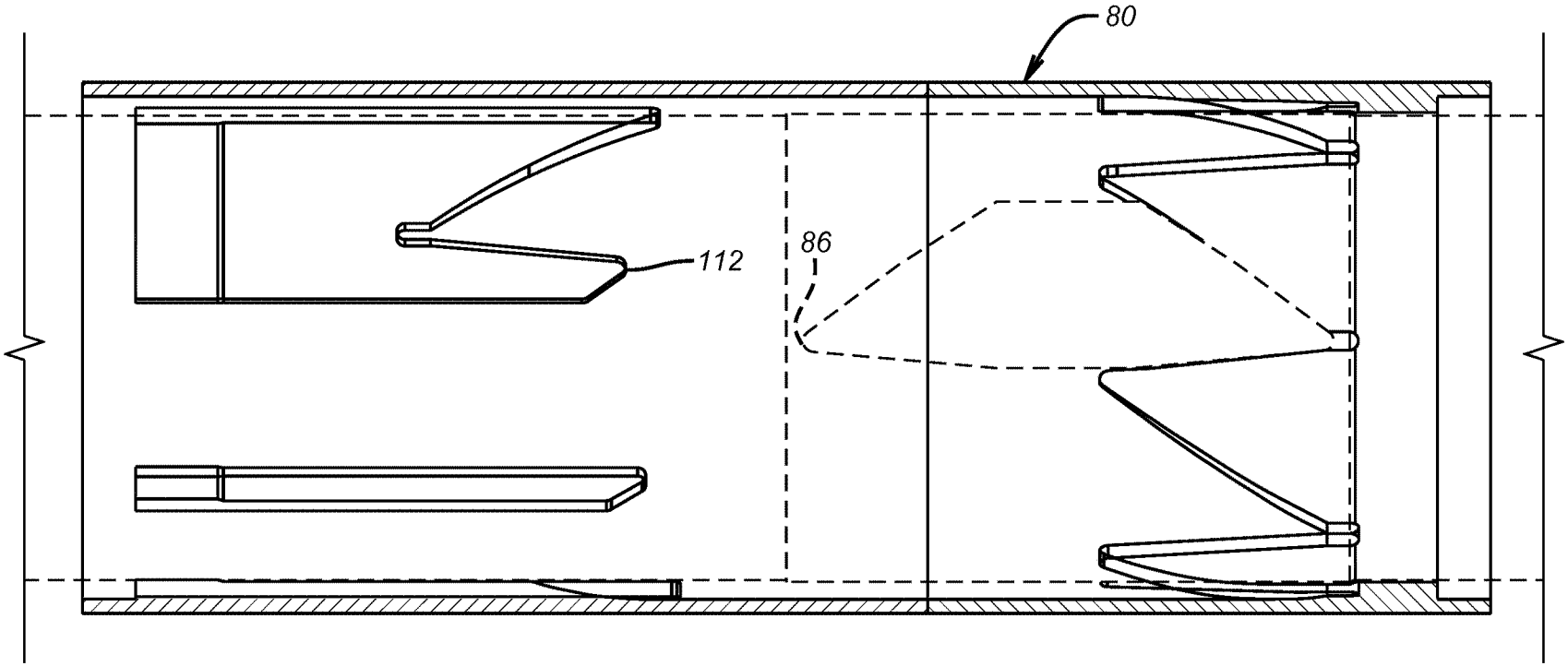
FIG. 4 shows the end of the stroke position after the view of FIG. 3.
Figure 5:
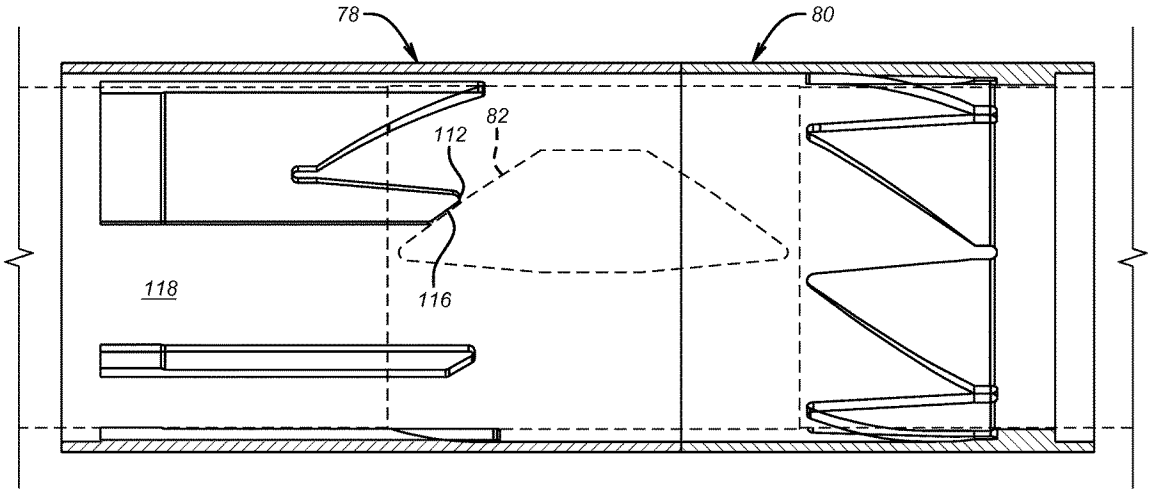
FIG. 5 is the continuation of movement from the FIG. 4 position again showing a position where backing off the stroke will not cause jamming.
Figure 6:
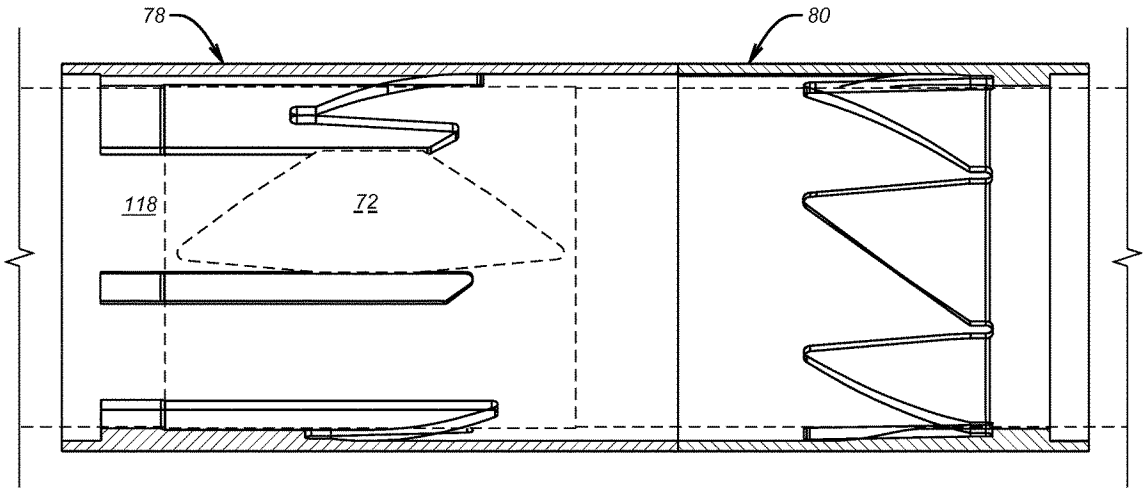
FIG. 6 is the end of a stroke view after FIG. 5.

At the same time in FIG. 3 it can be seen that on indexing sleeve 78 there are spaced peaks 110 and 112 with a valley 114 having preferably the same shape and dimensions as between peaks 106 and 108 where the lug 72 is heading. At the exact point of FIG. 3 if the piston that drives the tubular shaft 70 has its motion reversed in part stroke the lug 72 will simply reverse direction and head toward valley 114 while still being clear of peak 112. On the other hand if the piston stroke is allowed to finish to bring the lug 72 toward valley 104 as shown in FIG. 4 it can be seen that the rounded end 86 has gone around past the peak such that a reverse in the movement direction of lug 72 from the FIG. 4 position as shown in FIG. 5 will have surface 82 engage surface 116 so that the axial movement of the lug 72 can continue into slot 118 to get the next desired position of the subterranean tool, preferably a choke valve. This next position is seen in FIG. 6. However, somewhere between the FIG. 3 and FIG. 4 positions the rounded end 86 of lug 72 will align longitudinally with peak 112 such that if the piston stroke is stopped and reversed the end 86 will run square into the peak 112. While the rounded nature of the end 86 and peak 112 will resist deformation leaving a possibility that by repeated exercise of the piston driving shaft 70 that the continued normal operation can resume, there is still a potential for sticking the choke if the reversal of direction of the piston movement occurs fairly late in its stroke as compared to the prior design of FIG. 1. One of the reasons for this is that the peaks on sleeves 78 and 80 have been moved away from each other as compared to FIG. 2 peaks 48 and 50. In the FIG. 2 design the pin spacing measured axially gets as close as ⅛" to the nearest peak in the axial direction. On the other hand the axial spacing between opposing peaks in FIGS. 3-6 is larger than in FIG. 2 and ranges from over ⅛ inch to beyond 3". The closest spacing of rounded ends 86 and 88 get to any peak with which they come into alignment is over ¼". What this means is that the piston can stroke further to get to the FIG. 3 position before the lug 72 initiates tandem rotation of sleeves 78 and 80 to bring rounded end 86 into axial alignment with peak 112 so that if piston movement is reversed at that exact moment of alignment then there would be a jamming risk. The additional time of lug movement before rotation is initiated gives the operator at the surface more time to realize that the piston was stroked in error and an opportunity to reverse the piston movement with no risk of jamming the opposed ramp assembly and making the choke incapable of further operation.

The reason that the profiles on sleeves 78 and 80 can be moved further away is that the lug 72 is a load bearing travel stop so that the surfaces 34 and 38 and the lug that lands on them 36 are all eliminated. This allows eliminating lug travel grooves 46 shown in FIG. 2. Notice that sleeve 80 has no axial grooves for travel of the lug 72. Instead the conforming shapes of the leading end of the lug 72 in the direction of travel and the valleys 102 or 104 as defined by the adjacent sloping surfaces such as for example 96 and 98 smoothly initiate the rotation of the sleeves 78 and 80 represent a stop position in one direction. Lug 72 movement in the opposite direction can have the lug 72 be stopped by entering between peaks such as 110 and 112 and into valley 114 which was the position just before lug 72 movement reversed in FIG. 3. Alternatively the lug 72 can enter one or more open slots such as 118 in which case there will be some other travel stop for the shaft 70 that is outside the opposed ramp pattern between the profiles on sleeves 78 and 80. Open slots such as 118 are needed in part to be able to assemble the lug 72 into a position between the shaped profiles in sleeves 78 and 80.

Figure 2:
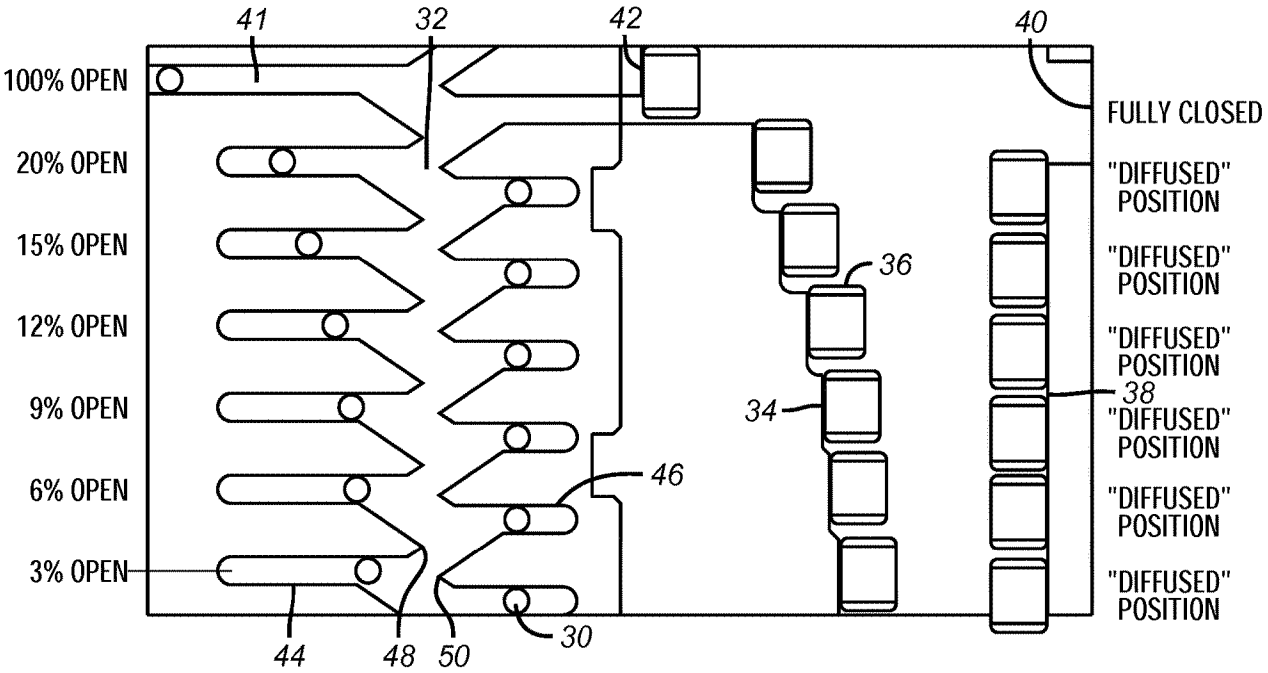
(PRIOR ART) FIG. 2
FIG. 2 is a rolled flat view of a prior art j-slot pattern associated with the choke of FIG. 1.

Lug 72 is shown with leading tapers of intersecting surfaces heading into what is a conforming shape to induce rotation until the shapes fully register as shown in FIGS. 3-6. However, the shapes are not required to fully register as shown as long as enough rotation is induced in each stroke of the piston that moves shaft 70. The shape of the profile and the leading end of the lug 72 do not have to be conforming as long as the needed rotation is induced by the end of the piston stroke. On the other hand, the fact that the lug 72 is strong enough to be load bearing in the profiles of sleeves 78 and 80 means that the profile of peaks and valleys in sleeve 80 need no axial travel slots or the travel stop mechanisms shown in FIG. 2. Thus dispensing with the axial travel slots in sleeve 80 enables separation of the opposing peaks in sleeves 78 and 80 while using the same piston stroke length. The increase in peak to peak axial spacing by a factor of as much as 24 times or more provides for more piston stroke time before rotational movement starts so as to give the operator more time to reverse piston movement in part stroke without jamming the opposed ramp mechanism. The shape of the valleys, such as 104 for example, allows some flexibility of the adjoining walls to promote rapid release of the lug 72 when shaft 70 changes direction. The lug 72 preferably has a conforming shape in the profiles that act as travel stops in the sleeves 78 and 80. Such contact is shown in FIGS. 3-6 as line contact along intersecting surfaces but the contact can be along a point or a curved surface as an alternative. The profile separation in the order of 24 times or more from the prior designs such as in FIG. 2 allows more reaction time to reverse piston stroke before a risk of jamming ensues. The greater peak to peak separation also allows more lug movement before rotation starts so that the jamming risk to the extent it exists occurs later in the piston stroke again providing more reaction time to reverse piston movement without a jamming risk. The load bearing capacity of the lug in environments where differential pressure loads from differentials that can be over 10,000 PSI are a feature not normally found in subterranean tools with opposed ramp actuation mechanisms. While the drawings show a reciprocating driven lug between opposed profiles that rotate in tandem, the arrangement can be reversed where the patterns reciprocate and the lug rotates. While reference to edge surfaces of the lug and profile have represented them as straight lines it is recognized that the lug and profile are mounted to cylindrical shapes and the references to straight lines are in reference to the appearance such surfaces would have when rolled flat in the manner that the prior art FIG. 2 is a rolled flat representation.

The above description is illustrative of the preferred embodiment and many modifications may be made by those skilled in the art without departing from the invention whose scope is to be determined from the literal and equivalent scope of the claims below:

I claim:

1. An actuation system for a tool disposed at a subterranean location, comprising:

a reciprocating shaft having a lug, said lug disposed between opposed first and second profiles respectively mounted on rotatably mounted sleeves such that engagement of said lug with said profiles selectively causes at least one said sleeve to rotate;

at least one of said profiles having no axially oriented travel slots for said lug; wherein said first and second profiles each featuring circumferentially spaced apart peaks, said peaks on said first profile circumferentially offset from said peaks on said second profile, an axial distance between said peaks on said first and second profiles is at over ⅛"; and an axial peak distance between said profiles allows increased axial movement of said lug before tandem rotation of said sleeves is initiated to allow more time for initiation of a reversal of movement direction of said lug without jamming said lug on an adjacent peak during said movement reversal.

2. The system of claim 1, wherein:

one end shape of said lug conforms to the shape of said first profile for contact therewith, said first profile having no axially oriented travel slots for said lug.

3. The system of claim 2, wherein:

said profile having no axially oriented travel slots enables enlarging an axial gap between said profiles with no change of stroke length for a piston that reciprocates said lug.

4. The system of claim 1, wherein:

said lug selectively engages said first and second profiles to resist operational loads imposed on the tool at the subterranean location.

5. The system of claim 1, wherein:

said first and second profiles each featuring circumferentially spaced apart peaks, said peaks on said first profile circumferentially offset from said peaks on said second profile, said lug coming no closer, when axially aligned to any of said peaks than ¼".

6. The system of claim 1, wherein:

said lug having opposed first and second ends each made of pairs straight surfaces oriented for intersecting when viewed rolled fiat;

said first profile has a mating shape of intersecting straight surfaces when rolled flat such that alternating peaks separated by valleys comprise said first profile.

7. The system of claim 6, wherein:

said peaks and valleys of said first profile extend for 360 degrees.

8. The system of claim 7, wherein:

said second profile has a mating shape to one of said second end of said lug made of intersecting straight surfaces when rolled flat such that at least a part of said second profile comprises alternating peaks separated by valleys.

9. The system of claim 8, wherein:

at least some pairs of peaks on said second profile have no valley between them, said lug insertable between one pair of said peaks with no valleys for assembly between said first and said second profiles.

10. The system of claim 8, wherein:

said lug has a trapezoidal shape when rolled flat with a pair of axially oriented parallel sides.

11. The system of claim 6, wherein:

said valleys on at least one of said profiles comprise an axially extending groove shorter than the axial distances between one said peak and adjacent said valley.

12. The system of claim 11, wherein:

said groove comprises an open end which forms a continuation of said straight surfaces oriented for intersection and a rounded closed end;

said groove length is less than 10% of the axial distances between one said peak and adjacent said valley.

13. The system of claim 11, wherein:

said valleys on both said profiles comprise an axially extending groove shorter than the axial distances between one said peak and adjacent said valley.

14. An actuation system for a tool disposed at a subterranean location, comprising:

a reciprocating shaft having a lug, said lug disposed between opposed first and second profiles respectively mounted on rotatably mounted sleeves such that engagement of said lug with said profiles selectively causes at least one said sleeve to rotate;

at least one of said profiles having no axially oriented travel slots for said lug:

said first and second profiles each featuring circumferentially spaced apart peaks, said peaks on said first profile circumferentially offset from said peaks on said second profile, an axial distance between said peaks on said first and second profiles is at over ⅛";

said axial peak distance between said profiles allowing increased axial movement of said lug before tandem rotation of said sleeves is initiated to allow more time for initiation of a reversal of movement direction of said lug without jamming said lug on an adjacent peak during said movement reversal.

15. An actuation system for a tool disposed at a subterranean location, comprising:

a reciprocating shaft having a lug, said lug disposed between opposed first and second profiles respectively mounted on rotatably mounted sleeves such that engagement of said lug with said profiles selectively causes at least one said sleeve to rotate;

said lug selectively engages said first and second profiles to resist operational loads imposed on the tool at the subterranean location;

said lug having opposed first and second ends each made of pairs of intersecting straight surfaces when viewed rolled flat;

said first profile has a mating shape of intersecting straight surfaces when rolled flat such that alternating peaks separated by valleys comprise said first profile;

said valleys on at least one of said profiles comprise an axially extending groove extending away from adjacent peaks that define said valley and shorter than the axial distances between one said peak and an adjacent said valley.

16. The system of claim 15, wherein:

said second profile has a mating shape to one of said second end of said lug made of intersecting straight surfaces when rolled flat such that at least a part of said second profile comprises alternating peaks separated by valleys.

17. An actuation system for a tool disposed at a subterranean location, comprising:

a reciprocating shaft having a lug, said lug disposed between opposed first and second profiles respectively mounted on rotatably mounted sleeves such that engagement of said lug with said profiles selectively causes at least one said sleeve to rotate;

said first and second profiles each featuring circumferentially spaced apart peaks, said peaks on said first profile circumferentially offset from said peaks on said second profile, an axial distance between said peaks on said first and second profiles is at over ⅛;

said axial peak distance between said profiles allowing increased axial movement of said lug before tandem rotation of said sleeves is initiated to allow more time for initiation of a reversal of movement direction of said lug without jamming said lug on an adjacent peak during said movement reversal.

* * * * *